United States Patent [19]

Wolter

[11] Patent Number: 4,550,689

[45] Date of Patent: Nov. 5, 1985

[54] GAS INSTANTANEOUS WATER HEATER

[76] Inventor: Gerry Wolter, 2341 Maryland Ave., Cincinnati, Ohio 45204

[21] Appl. No.: 546,874

[22] Filed: Oct. 31, 1983

[51] Int. Cl.[4] ..... F22B 37/42; F22D 5/00

[52] U.S. Cl. ..... 122/448 R; 122/18; 122/245; 122/248; 122/250 R; 126/351; 237/8 D

[58] Field of Search ..... 122/3, 18, 448 R, 245, 122/248 R, 250 R; 236/25 R; 237/8 D; 126/351

[56] References Cited

U.S. PATENT DOCUMENTS

| | | | |
|---|---|---|---|
| 1,271,487 | 7/1918 | Reid | 122/248 |
| 1,515,771 | 11/1924 | Hardie | 126/351 |
| 1,602,389 | 10/1926 | Beler | 122/18 |
| 2,169,683 | 8/1939 | Dunham et al. | 122/448 R |
| 3,363,766 | 1/1968 | Van Den Broek et al. | 122/18 R |
| 3,437,414 | 4/1969 | Gorman | 431/79 |
| 3,887,325 | 6/1975 | Finger et al. | 122/448 R X |
| 4,086,773 | 5/1978 | Kanegae et al. | 122/3 X |
| 4,127,085 | 11/1978 | Katz et al. | 126/351 X |
| 4,147,159 | 4/1979 | Thorwaldson | 122/448 A |

*Primary Examiner*—Edward G. Favors
*Attorney, Agent, or Firm*—Frost & Jacobs

[57] ABSTRACT

Disclosed is a gas instantaneous water heater for use in boats or recreational vehicles comprising a housing divided into a large upper portion and a small lower portion. A gas valve and electric filament lighter are controlled by an electronic module which opens the gas valve and ignites the gas in response to a signal from a sensor capable of sensing water flow or a pressure drop. The heater employs a photoelectric flame sensor and a thermal override switch to shut off the gas in the event the igniter fails to ignite the gas or if the water temperature is excessively high.

19 Claims, 5 Drawing Figures

GAS INSTANTANEOUS WATER HEATER

BACKGROUND OF THE INVENTION

1. Field of the Invention

This invention pertains to gas instantaneous water heaters for boats or recreational vehicles.

2. Description of the Prior Art

Existing gas instantaneous water heaters are designed for use within the home or commercial building which occupy a large volume of space and generally approach 1,000 pounds or more in weight. Touching certain portions of the exterior of the instantaneous water heater, while in operation, can cause severe burning. For this reason, existing devices cannot be mounted adjacent any wall surface or flammable surface and are usually mounted in a closet or utility room to prevent children, pets, etc. from inadvertently contacting the apparatus.

Consequently, because of the size and weight of existing apparatus, a need exists for a small light weight gas instantaneous water heater for use on boats and RV vehicles. Moreover, a need exists for an instantaneous water heater which can be mounted either inside or outside the boat or vehicle. If it is mounted on the inside, it must be easily vented to the outside, yet be sufficiently insulated so as to be capable of fitting within small spaces without fear of burning the surrounding environment. Furthermore, because none of the home models are designed with such factors as small spaces and surrounding environment, they lack the necessary safety elements which must accompany a small gas instantaneous water heater.

U.S. Pat. No. 3,887,325, issued to Finger, et al., teaches an instanteous water heater for use in deicing airplanes, and more particularly to a control method and apparatus for the burners which heat the water. This apparatus does not have the same problems as the present invention in that it is designed generally for use outside in cold weather. Consequently, venting gases and heating surrounding areas are of little importance in the operation and function of this device.

U.S. Pat. No. 3,981,344, issued to Gouyon-Beauchamps discloses a safety device for instant water heaters and specifically a control system to permit venting the combustible gases into the living area of a dwelling and yet prevent dangerous levels of combustible poisonous gases from accumulating in the room. This device has safety considerations exclusively caused by operating and venting the device within the living area of a dwelling. Furthermore, the amount of air leakage into the dwelling area in which the water heater is mounted must be known to calculate the length of time the water heater can operate before critical levels of poisonous gases accumulate. Consequently, this device is non-analogous art as compared to the present invention.

U.S. Pat. No. 4,147,159 to Thorwaldson teaches the typical heavy, bulky instantaneous water heater generally employed in a home or commercial building which possesses all the above noted problems. This device, because of its size of weight and because of its uninsulated character, is not suitable for use in a boat or recreational vehicle.

U.S. Pat. No. 4,184,457 to Trotter, et al teaches a water flow responsive control for a liquid heater. This device primarily relates to the typical instantaneous water heater used in a home or commercial building, but is primarily directed toward a control capable of sensing the amount of flowing water and controlling the flow of gas based upon the amount of flowing water. As the volumetric flow rate of the water increases, the flow of gas to the heater increases, thus maintaining a constant temperature hot water output. Such an elaborate control occupies great space and is not useful in boats and recreational vehicles, and therefor this device is not pertinent to the present invention.

U.S. Pat. No. 4,346,835 to Trotter, et al discloses a gas instantaneous water control valve employing several actuators in several chambers and a gas venturi. This device, like the other Trotter, et al device, is cumbersome and bulky, and occupies vast space to be of value in a boat or recreational vehicle.

None of the above prior art references are adaptable or even useful in a boat or recreational vehicle, because of the problems inherently associated with the various devices that must be overcome. Consequently, the need exists for a small, lightweight instantaneous hot water heater capable of being mounted on a boat or recreational vehicle.

SUMMARY OF THE INVENTION

The present invention comprises a gas instantaneous water heater including a casing with a large compartment and a small compartment separated by a dividing wall; a gas inlet coupler attached to the casing through the lower compartment and capable of being coupled to a source of gas; an electric gas solenoid valve positioned near the gas inlet coupler, which is normally closed; three gas nozzle jets positioned in the large compartment on the dividing wall and being fluidly connected to said gas inlet coupler in said small compartment; a water coupler connected to said casing through said large compartment and capable of being connected to a source of water; a plurality of coils connected to said hot water coupler, which surround said gas nozzle jets in said large compartment; a water outlet line which projects through said lower compartment and is fluidly connected with said coils in said large compartment; an electronic igniter positioned adjacent one of said gas nozzle jets which is capable of igniting all the gas nozzle jets; an optical flame sensor positioned in said small compartment which is capable of optically sensing flame in said large compartment; a thermal overriding switch fastened to said water outlet pipe for sensing outlet water temperature and interrupting the operation of said electric gas solenoid valve if said water is too hot; and an electronic control module for operating said heater, when said water is flowing through said coil.

A process for operating the gas water heater of the present invention comprises the steps of: simultaneously causing water to run through a heating coil and activating an electronic igniter; activating an electric gas solenoid valve approximately one second after igniting the electric igniter, which causes gas to flow to a gas nozzle jet adjacent said electronic igniter, thereby igniting said gas jets and heating said water in said coil; activating an optical flame sensor approximately three seconds after said electric gas solenoid valve has been activated, to sense the presence of a flame which, if sensed, causes said electric solenoid gas valve to remain activated or, if not sensed, causes said electric gas solenoid valve to deactivate, interrupting the current to said valve, whereby said valve closes.

DESCRIPTION OF THE PREFERRED EMBODIMENTS

The present invention is a gas instantaneous water heater adapted to be mounted on a wall, and preferably an outside wall of a boat or a vehicle. Its width is approximately 8¼ inches, the height is approximately 10¼ inches and the depth is approximately 3¾ inch. The apparatus is made primarily from stainless steel with brass fittings and copper tubing, and weighs approximately 9 pounds. The solid state controls are activated by 12 volts, the controls consist of electric ignition, electric solenoid gas valve, and an optical flame sensor. A thermal overheating safety switch is in series with the gas valve and does not work through the solid state controls. The output of the heater is approximately 14,500 BTU's per hour and employs liquid propane under approximately 11 water column inchs of pressure or compressed natural gas.

The device is encased in a stainless steel casing which is divided into an upper portion comprising approximately two-thirds of the volume of the casing and a lower portion containing the remaining volume. The upper casing can be completely lined with non asbestos ceramic or include a spaced inner double wall such that the casing does not retain sufficient heat to burn or ignite the surrounding environment.

The gas inlet is found in the lower portion of the casing and is immediately controlled by an electric solenoid gas valve which is normally closed and is opened when activated by a 12 volt current. The gas line is attached to three nozzles, the point of attachment being the dividing wall between the upper and lower chambers of the casing. Each of the three nozzles heats a specific set of associated heating coils, with the residual heat from the nozzles being used to heat a fourth coil.

The water inlet is found in the upper chamber of the casing and is immediately split into two portions by a T-coupler. Each portion accommodates two specific coils wherein water flows into one coil and then into a second coil, consecutively. Thus, each portion of the water has traveled through two sets of coils and is heated to the desired temperature. Both portions are recombined by a T-coupler and exit the casing in another pipe. The bottom and back walls of the lower chamber in the casing contain air holes permitting air to flow inwardly. The dividing wall separating the upper and lower chambers likewise possesses air holes and the top of the upper chamber includes a vent in which the combustion and noxious gases are vented to the atmosphere.

Electric current for the circuit is supplied by a 12 volt battery, and powers an off-on switch, at least one timer, an electric igniter, a photo-electric eye for sensing flame, a solenoid gas valve, and either a push-start button, electric faucet, or pressure drop switch, any of which are capable of activating the electronic module.

Figure 1:
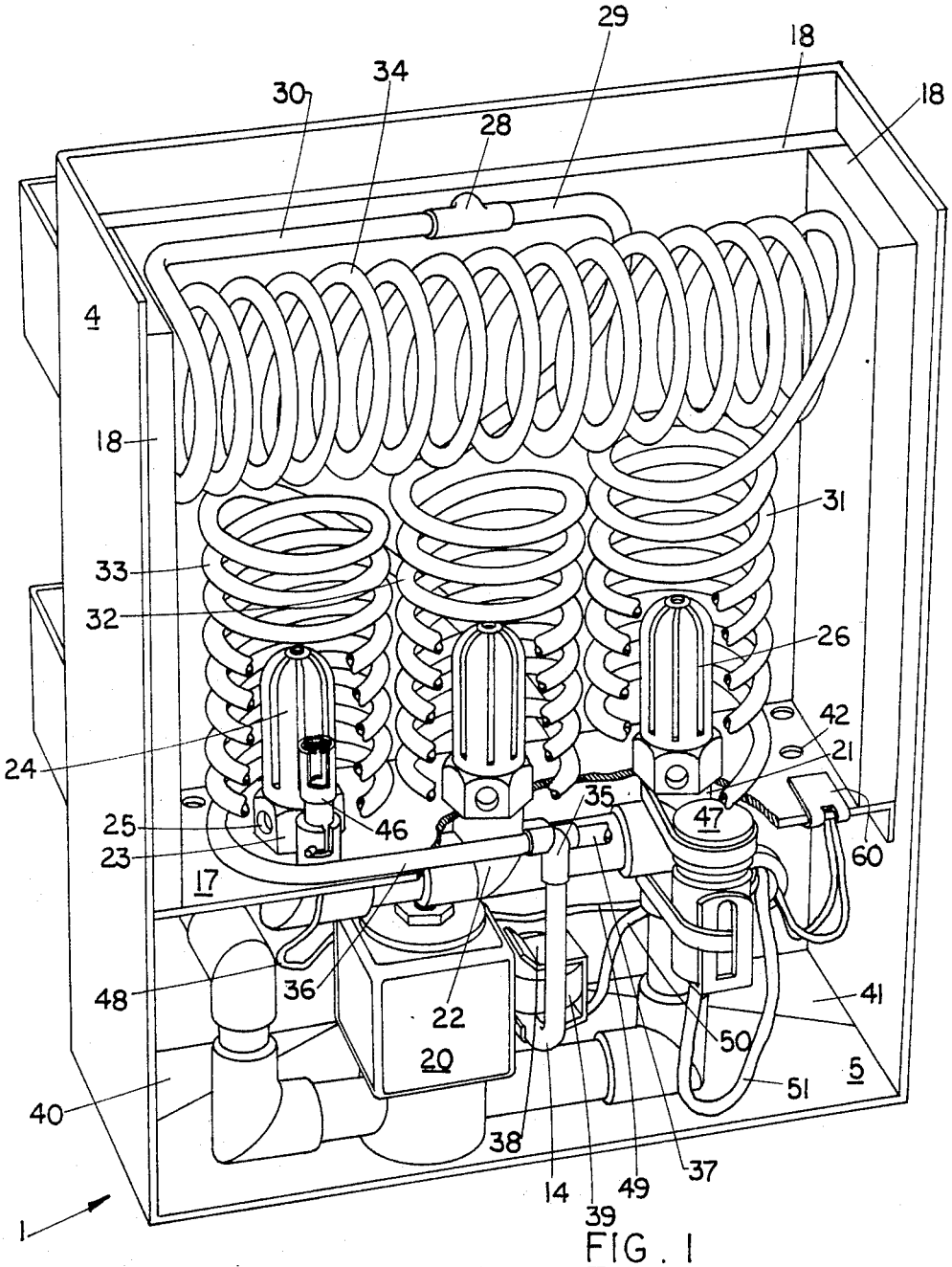
FIG. 1 shows a front perspective view of the gas instantaneous water heater, with the cover plate being removed.
Figure 2:
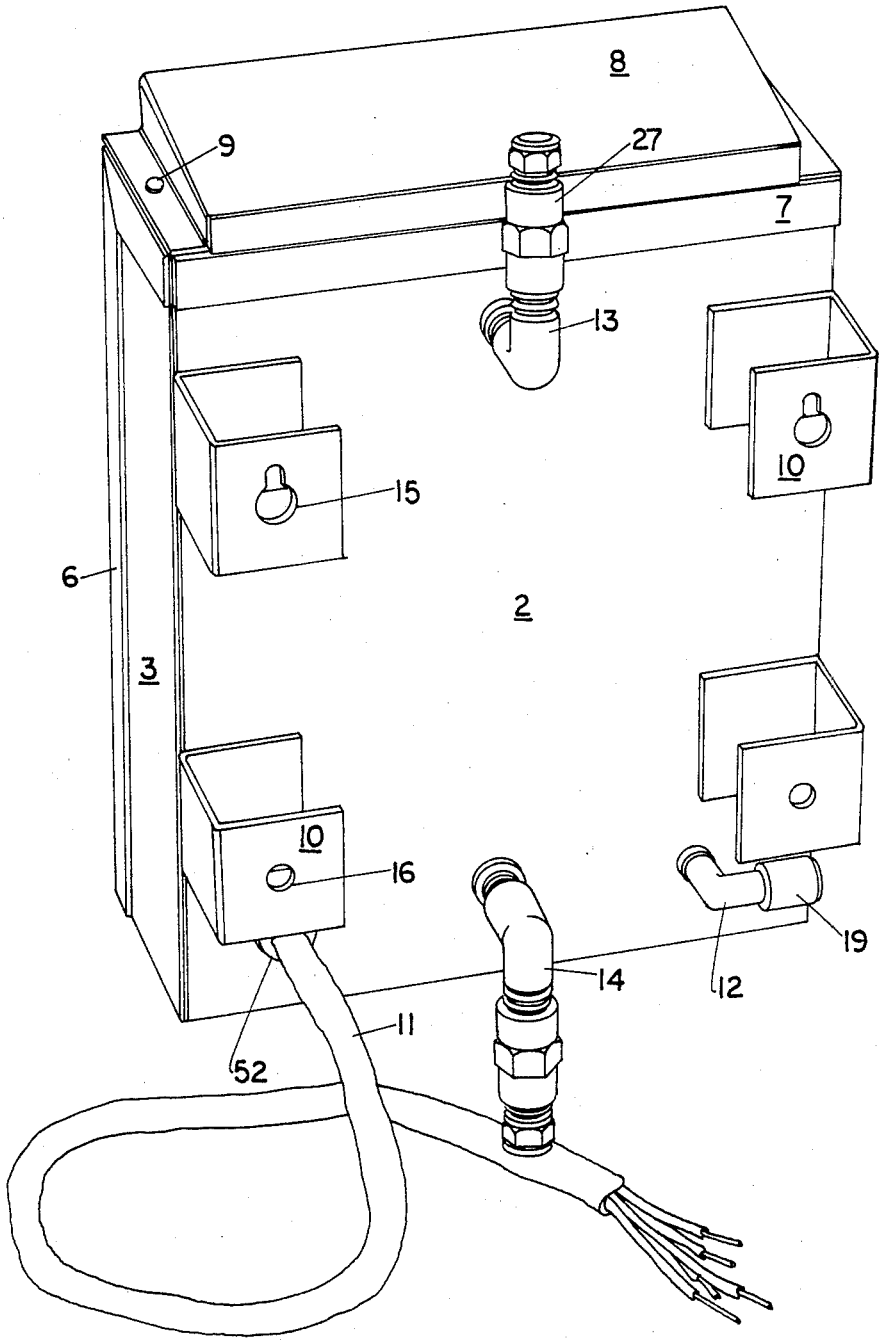
FIG. 2 shows a rear perspective view of the gas instantaneous water heater.

As illustrated in FIGS. 1 and 2, the stainless steel casing 1 for the gas instantaneous water heater comprises an integrally formed back wall 2, side walls 3 and 4, and bottom wall 5 which are generally formed from one piece of sheet metal, wherein the side walls and bottom are bent to the desired angle. The front plate 6 and top plate 7 are also an integral piece formed from a single piece of sheet metal wherein the top plate 7 is bent to the desired angle. Plates 6 and 7 are generally fastened to the casing with screws 9, for example. The back wall of the casing contains four mounting brackets 10 generally U-shaped with one side of the U-shaped bracket being permanently affixed to the back of the casing. Four holes are generally drilled into the back wall for the wiring 11, gas inlet 12, water inlet 13 and water outlet 14. The top of the casing can additionally be fitted with a vent 8 designed to prevent rain or other objects from falling into the instantaneous water heater.

Figure 5:
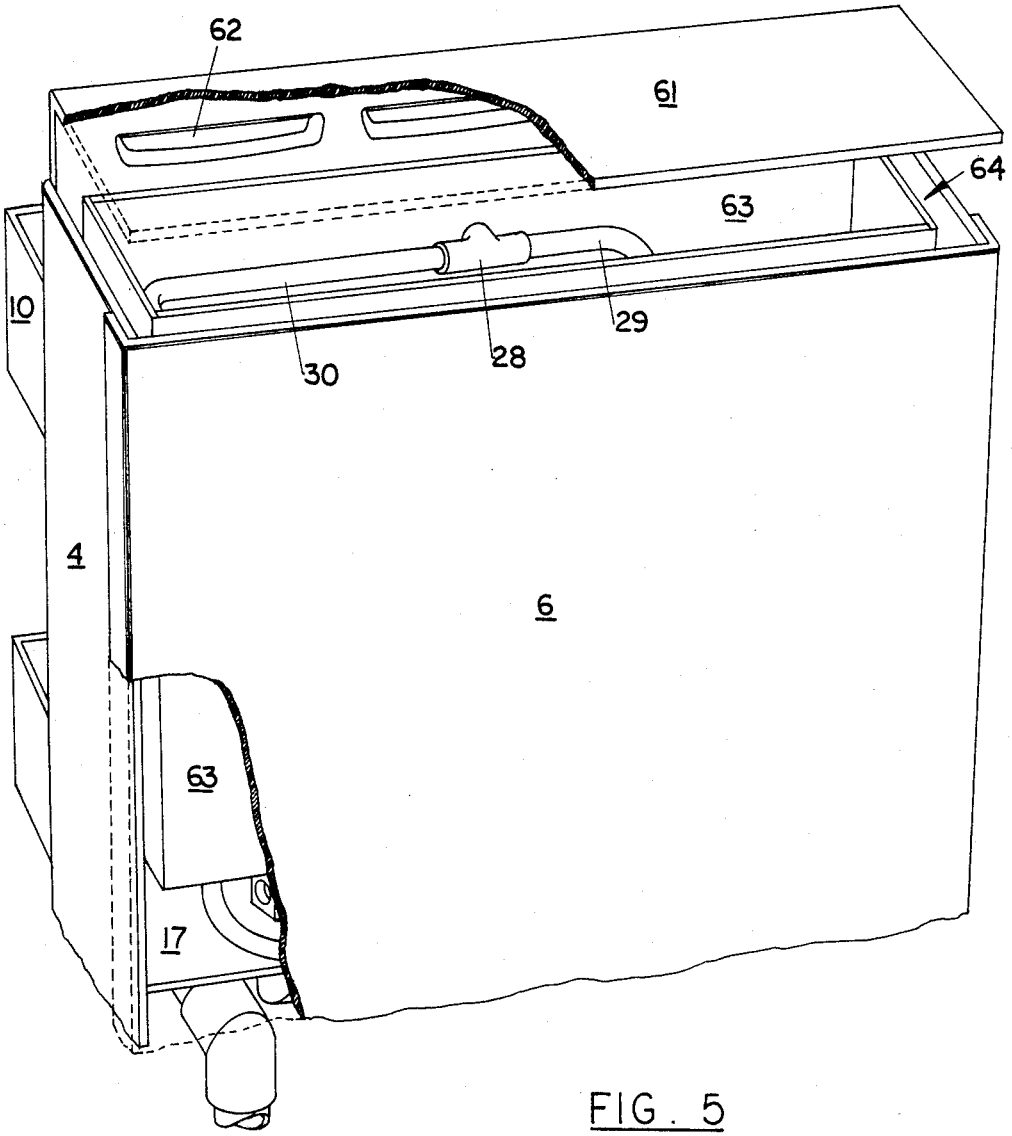
FIG. 5 shows a cut-away perspective view of a modification of the gas instantaneous water heater.

FIG. 5 illusrates a modification of the FIG. 1 heater. The back, sides and bottom walls of the FIG. 5 casing are integrally formed with vent lid 61. The vertical portion of vent lid 61 contains at least one louver-like opening 62 is designed to direct the air upwardly as it passes from the front of the heater through opening 62, to the back of the heater.

Although the casing and mounting brackets are generally made of stainless steel, other metals or plastics are likewise suitable. For example, a thermal plastic capable of withstanding the heat generated during operation, would be an acceptable light weight material from which to form the casing, and it is inert to salt water and most other outdoor environmental conditions.

The mounting brackets are generally of the type known wherein the upper mounting brackets employ key shaped orifices 15 on the side of the U-shaped bracket opposite the side integrally attached to the casing. A bolt or screw capable of fitting through the large portion of the key shaped orifice permits the heater to drop downwardly, allowing the bolt or screw to slide into the narrow portion of the key shaped orifice. The bottom mounting brackets generally contain a single hole 16 through which screws, bolts or pegs can be employed to stabilize the heater upon a vertical surface.

The inside of the casing is divided into two portions, an upper portion comprising approximately two-thirds thirds of the volume of the casing, and a lower portion comprising the remaining volume, the two portions being separated by a dividing wall 17 having the same width as the container, but having a recessed depth thereby providing a mounting surface for the components, and partially restricting ambient light from below while allowing combustion air to flow from the lower chamber to the upper chamber. In the modified heater of FIG. 5, dividing wall 17 occupies the entire cross-sectional area of the casing. In particular, dividing wall 17 is not recessed and consequently it substantially reduces reflected ambient light, which permits the flame sensor to function more accurately.

Generally all the surfaces in the upper chamber of the casing are lined with insulation 18 or are provided with a liner wall 63 to prevent heat from being transferred to the metal casing and thus causing scorching or ignition of surrounding materials. The insulation or double wall also maintains the exterior of the casing at a cool temperature so as to prevent burning those who may accidentally contact the heater.

GAS FLOW

The gas enters the casing through the back wall of the lower chamber via a coupler 19 designed to quickly connect the heater to a gas supply pipe generally found on boat docks or associated with liquid propane tanks.

Figure 4:
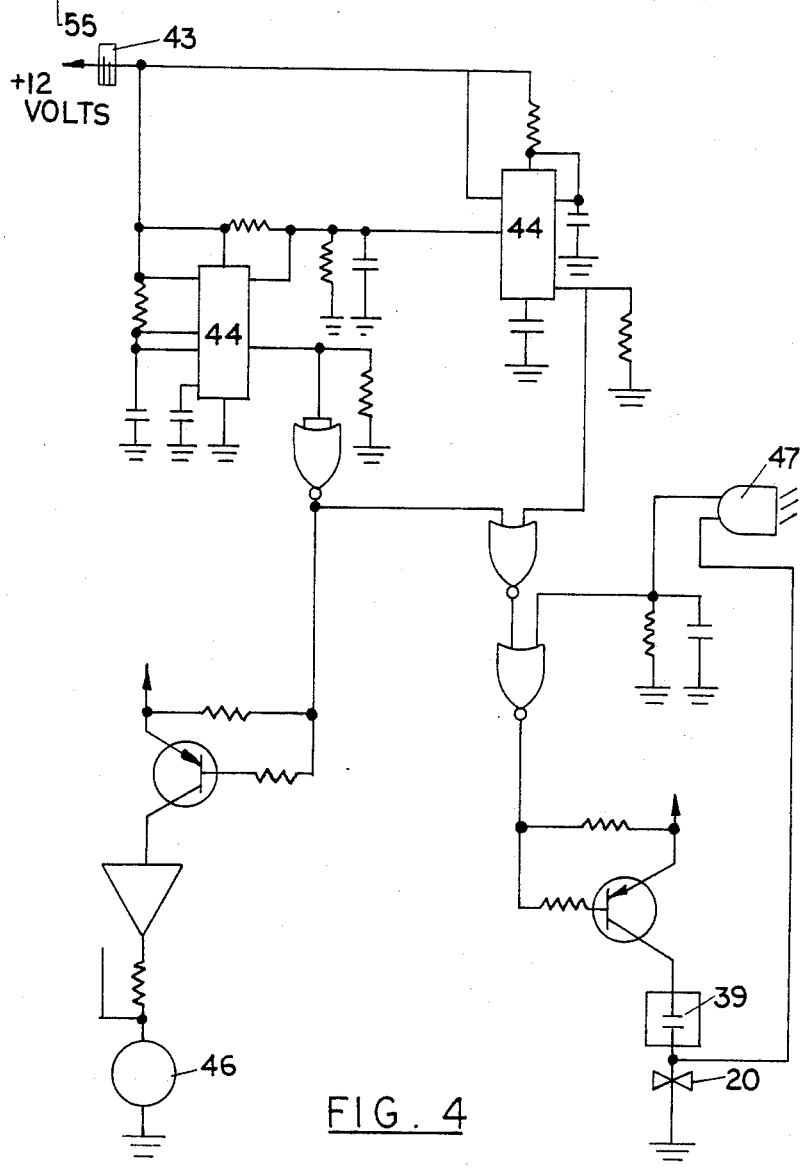
FIG. 4 shows an electric circuit schematic for the instantaneous water heater.

A 12 volt normally closed electrical gas solenoid valve 20 is positioned near the inlet of the gas line and is controlled by the electronic module shown in FIG. 4. From the solenoid valve, the gas pipe splits into three projections 21, 22 and 23, which project through dividing wall 17 from the lower chamber to the upper chamber of the casing. Gas nozzles 24, shaped as cylindrical domes, are integrally fastened with each of the three projections. The nozzles contain openings 25 in their base portion which aspirate air whenever the gas is flowing. The gas and air mixture exits through slit openings 26 arranged around the perimeter of the top of the nozzle and are combusted. Consequently, the gas nozzle provides an evenly distributed gas flow pattern which assures an even distribution of heat in all directions around the nozzle. The combusted gases rise through the casing and exit through vent 8.

The water inlet line 13 projects through the upper back portion of the casing and contains a quick coupler 27 for connecting the water supply line with the water inlet. Once the water line is inside the upper casing, it is immediately divided into two portions by T-coupler 28. Each portion 29 and 30 simultaneously transports water into two serially connected coils, each portion achieving the maximum surface area of the coils exposed to the heat and, consequently, instantaneously producing hot water. Three of the coils 31, 32 and 33 are wound around and above the nozzles of the gas jets, while the fourth coil 34 extends over the top of all three coils, and thus receives residual heat rising from each of the coils and from each of the gas nozzles. As the two portions 29 and 30 are heated to the temperatures desired, which is determined by the water flow rate, the respective outlet pipes 36 and 37 are recombined by means of T-coupler 35 into a single outlet 14. The outlet can extend through the back wall of the upper casing or, as is shown in FIG. 1, can project through dividing wall 17 and into the lower chamber before exiting the casing. This last mode is preferable because the thermal override switch 39 must be coupled (by clip 38) to the outlet conduit 14 near its exit point, and should not be positioned in the upper chamber where the thermal switch may be measuring the temperature of the nozzles as opposed to the temperature of the water.

The coils are typically formed of copper as are all the T-couplers, and water inlet and exit lines. The quick couplers 19 and 27 on the inlet and exit lines are generally formed of brass. Consequently, all the water supply lines can be soldered rather than connected by other means.

AIR FLOW

Generally the bottom of the casing contains at least two triangular openings 40 and 41 designed to permit air flow into the lower chamber. Optionally, openings 40 and 41 can be any shape and covered by a light filter made from, for example, expanded metal, plastic mesh, or steel wool. The light filter prevents reflected light from finding its way into theinterior of the chamber, thus enabling optical flame sensor 47 to function more efficiently. The light filter serves a second function of preventing debris such as leaves from entering the interior of the lower chamber. The dividing plate 17 between the lower and upper chambers of the casing likewise includes a multitude of openings 42 designed to permit air flow from the lower casing into the upper casing. Air is then aspirated by the nozzle and mixed with gas to be ignited and burned to completion. The exhaust gas then rises out the top of the casing through vent 8. Positioning the air holes in lower wall 5 of the casing and in dividing wall 17 between the lower chamber and upper chamber is the preferred location of the air holes. This prevents any accumulation of gas which may be leaking from the gas line in the lower chamber from causing an explosion when ignited. Also, by permitting air into the lower chamber, all the safety controls and electrical wiring are maintained as cool as possible to prevent melting of the insulation and to prevent melting of any plastic safety switches or other safety equipment.

Optionally, air openings could also be positioned in the back panel in the lower chamber. These openings would essentially accomplish the same purpose as the openings in the lower portion of the casing. Any air openings in the side walls of the casing may also be functionally equivalent, however, the openings positioned therein are less desirable because rain, salt water spray or other debris may interfere with the operation of the heater. By mounting the heater on a vertical wall or surface, openings in the back wall of the casing are more protected than openings in the side wall. Nevertheless, the preferred position for the air openings are in the bottom of the casing where no rain or sea water or other environment objects, such as leaves, are likely to find their way into the inside of the heater.

With respect to the modified FIG. 5 device, air is drawn into the upper chamber through rectangular slit 64 formed between the exterior of the inner liner wall 63 and the interior of casing 1. The inner liner wall 63 terminates above dividing wall 17 and consequently, air is aspirated by nozzles 24, which draw air from slit 64. Openings 40, 41 and 42 can be eliminated in the FIG. 5 modification because they are no longer necessary to draw air into the upper chamber. Nevertheless, it may be desirable to provide the lower chamber with some openings like 40 or 41 to disipate any gas which may inadvertently leak from the gas conduit. It may also be desirable to provide dividing wall 17 with some holes 42 in addition to holes 40 and 41 for allowing rain or water to drain from the casing.

CURRENT FLOW

FIG. 4 shows a schematic diagram of the current flow and electronic module which is powered by a 12 volt battery. In particular, a 12 volt battery is connected to a main off/on switch 43 capable of preventing current from finding its way to the heater. Primarily, this switch serves as an overriding circuit breaker. For example, this switch can serve to deactivate the water heater when it is not in use. The switch is connected to at least one standard timer 44, which is connected to a start push button 45, electric faucet, pressure drop or flow sensing switch for energizing the electronic module. The timer is also connected to an electric filament igniter 46, the electric solenoid gas valve 20, which is normally closed, and photoelectric eye 47 which senses flame and functions as a safety switch.

Electric filament igniter 46 is mounted in the large compartment of the heater on dividing wall 17 adjacent one of the gas jet nozzles. Electrical wire 48, connected to the filament igniter, is attached to the module through opening 52 in the dividing wall.

As previously alluded to, electric solenoid gas valve 20 is located in the small compartment. Also, thermal temperature override switch 39 is located in the small compartment attached to water outlet tube 14. Lastly, optical flame sensor 47 is likewise positioned in the lower compartment below several air orifice openings in dividing wall 17, such that it is capable of sensing flame in the upper chamber. All wires for the electric ignition filament 48, electric solenoid gas valve 49, thermal overriding switch 50, and optical flame sensor 51 exit from the heater in the lower chamber through the back wall by means of hole 52 circumscribed with a typical rubber grommet. The electronic control module is positioned adjacent the heater between the 12 volt source of current, typically a battery, and the heater. The solid state electronic control module is generally encased in epoxy and is resistant to rain, salt water, and other natural environment conditions.

Since the entire source of power is a 12 volt battery, all electrical components, such as the gas solenoid switch, electric igniter and optical flame sensor can be commonly ground to the casing as is illustrated by ground clip 60 shown in FIG. 1.

Although element 45 schematically represents a start button, an electric faucet, a pressure drop or flow sensing switch for energizing the electronic control module, the latter is the preferred element because it is most commonly found in boats and recreational vehicles.

Figure 3:
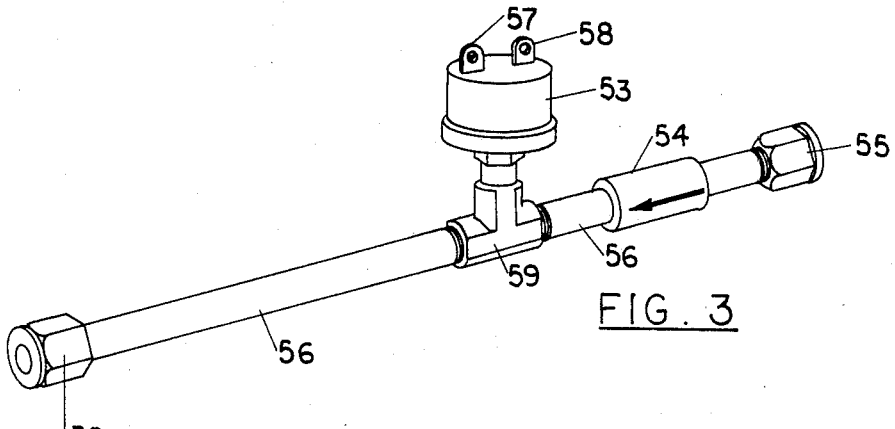
FIG. 3 shows perspective view of the in-line pressure drop switch and check valve.

FIG. 3 depicts pressure drop switch 53 fluidly connected to check valve 54 by means of "T" coupler 59 and water pipe 56. Each end of the water pipe shows quick release couplers 55, although these are not necessary to the present invention. Reference numerals 57 and 58 show electrical connection tabs.

As previously mentioned, pressure drop switches are commonly found on boats and recreational vehicles to energize the water pump when the faucet is opened. This same principle can be employed in the hot water line, along with the present invention, with minor modification. The minor modification requires a check valve 54 be incorporated into the water line between the pressure drop switch 53 and the hot water heater of the present invention. If a check valve is not employed, the pressure drop switch will also energize the pump *and* hot water heater when ever the cold water faucet is opened, because a pressure drop will occur through the heater to the pressure drop switch. By employing check valve 54, the water pressure between the check valve 54 and the hot water faucet will be maintained, and accordingly, the water heater will be energized by opening only the hot water faucet.

IN OPERATION

The operation of the gas instantaneous water heater is first initiated by an electric faucet, a separate switch or water pressure drop switch 53 as shown in FIG. 3. These various switches activate the electronic module causing several events to occur simultaneously. First, the water begins to flow through the copper coil heat exchangers and the electric igniter is activated. Approximately one second later the gas solenoid valve is opened, permitting gas flow to the gas nozzle jets where it ignites instantaneously. Approximately three seconds after the electric gas solenoid valve has been opened, the optical flame sensor is activated and will sense flame and maintain the gas valve open. Also, the igniter is turned off (having been on a total of approximately four seconds). If at any time after the initial ignition period the flames are extinguished, the optical sensor immediately deactivates the gas valve through the electronic module by interrupting the source of electricity which permits the gas valve to return to its normally closed position. If the heater should ever overheat due to a decrease in the water supply, or complete lack of water in the system causing a sustained exit water temperature over 170° F., the thermal switch will shut off the gas valve and not permit operation of the heater until it returns to a threshold temperature (approximately 140° F.). Thermal switch 39 is not routed through the electronic control module and, consequently, it can override the module.

To turn off the heater, one only has to deactivate the electronic control module by deactivating the electric faucet, or flipping the separate switch or, if a water pressure drop or flow sensing switch is employed, by merely turning the hot water faucet off. Such a procedure immediately deactivates the electric solenoid gas valve which returns to its normally closed position which extinguishes any flame. This procedure also deactivates the optical flame sensor and igniter and the module completely recycles itself requiring recognition in the manner previously described.

During initial operation, the entire electric system draws approximately two amps of current, while after initial ignition,, the system draws approximately one-half amp. Also, the electronic control module steps down the 12 volts of direct current to about 3 volts of direct current for the igniter.

To control the water temperature one merely has to control the rate at which water exits the heater. If hot water is desired then the water faucet should be turned on approximately one-quarter turn of the faucet. If warm water is desired, then the hot water faucet should be opened approximately three-quarters of a turn. If water approximately at body temperature is desired, then the faucet should be fully opened permitting approximately two-thirds of a gallon of water flow per minute depending upon such general factors as pump output pressure and incoming water temperature.

The gas instantaneous water heater can be employed for making coffee or tea, hot water for cleaning dishes and clothing, and warm water for showers. Most water saving shower spray nozzles use approximately one-half gallon of water per minute, which is well within the capability of the present invention. Consequently, in normal operation, the present invention is capable of supplying all the hot water necessary for a shower in a boat or recreational vehicle typically equipped with water saving shower spray nozzles.

If, however, more hot water is desired, the present invention can be connected to a hot water holding tank and thus one could employ the present invention to heat practically any desired amount of water, such that shower spray systems using three to four gallons per minute can be employed.

What I claim is:

1. An instantaneous gas water heater comprising a casing with a large compartment and a small compartment separated by a dividing wall; a gas inlet coupler attached to the casing through the small compartment and capable of being coupled to a source of gas; an electric gas solenoid valve positioned near the gas inlet coupler, which is normally closed; three gas nozzle jets positioned in the large compartment on the dividing wall and being fluidly connected to said gas inlet coupler in said small compartment; a water coupler connected to said casing through said large compartment and capable of being connected to a source of water; a plurality of coils connected to said water coupler, which surround said gas nozzle jets in said large compartment; a water outlet line which projects through said small compartment and is fluidly connected with said coils in said large compartment; an electronic igniter positioned adjacent one of said gas nozzle jets, which is capable of igniting all the gas nozzle jets; an optical flame sensor positioned in said small compartment which is capable of optically sensing flame in said large compartment; a thermal overriding switch means fastened to said water outlet pipe for sensing outlet water temperature and interrupting the operation of said electric gas solenoid valve is said water is too hot; and an electronic control module for operating said heater, when said water is flowing through said coil and for deactivating said heater when said water or said gas is not flowing through their respective lines.

2. An instantaneous gas water heater comprising: (1) a housing having a large compartment and a small compartment, said large compartment being a combustion chamber having a combustion air outlet, said large compartment being in communication with said small compartment, said small compartment having at least one opening therein so as to serve as a source of combustion air and to aid in maintaining any components therein at ambient temperature; (2) a gas inlet line coupled to said housing; (3) a valve in said small chamber coupled to said gas inlet line to control gas flow when a source of gas is attached to said gas inlet line; (4) at least one gas nozzle in said combustion chamber connected to said valve; (5) a water inlet line coupled to said housing; (6) at least one coil in said combustion chamber connected to said water inlet line, said coil surrounding said at least one gas nozzle; (7) a water outlet line connected to said at least one coil whereby water can flow into said water inlet line, through said at least one coil and exit through said water outlet line; and (8) a means for igniting said at least one gas nozzle when said water is flowing through said at least one coil to heat said water.

3. The heater of claim 2, wherein said large upper compartment is substantially lined with a thermal insulator.

4. The heater of claim 3, wherein said housing is made of stainless steel or thermal resistant plastic.

5. The heater of claim 2, wherein said valve is an electric solenoid valve.

6. The heater of claim 2, wherein said gas nozzle includes a foundation portion and a dome top portion, said foundation portion including at least one air aspiration opening, said dome top portion having gas outlet apertures.

7. The heater of claim 6, wherein said gas nozzle is three gas nozzles equally spaced across the length and width of said casing.

8. The heater of claim 2, wherein said water inlet line includes coupler means for splitting said inlet line into at least two conduits.

9. The heater of claim 8, wherein said coil is two coils and each of said conduits is connected to one of said coils.

10. The heater of claim 7, wherein said coil is for coils, with three of said coils surrounding said three gas nozzles with the remaining coil positioned perpendicularly above said three coils.

11. The heater of claim 2, wherein said means for igniting is an electric filament igniter.

12. The heater of claim 2 further including a flame sensor means in said small compartment which is capable of sensing flame from said at least one gas nozzle and maintaining said gas valve in an open position if flame is sensed or causing said gas valve to close if no flame is sensed.

13. The heater of claim 12, wherein said flame sensor means is an optical flame sensor.

14. The heater of claim 12, further including a thermal override switch means in said small compartment which is capable of sensing the water outlet temperature in said water outlet line and maintaining said gas valve open if the temperature is within a preestablished range, or causing said gas valve to close if said temperature is sustained above said preestablished temperature range.

15. The heater of claim 2, further including an electronic control module means for controlling said gas valve and said igniter.

16. The heater of claim 13, further including an electronic control module means for controlling said valve, said igniter, and said optical flame sensor.

17. The heater of claim 16, wherein said electronic control module means is activated by a switch means capable of sensing flowing water.

18. The heater of claim 17, wherein said electronic control module means further performs the function of controlling said valve, said igniter and said optical flame sensor by causing said igniter to activate simultaneously when said electronic control module means is activated, after approximately one second causing said valve to open thereby igniting said gas nozzle, after four seconds causing said igniter to deactivate and to simultaneously activate said optical flame sensor.

19. The heater of claim 2, wherein said at least one coil is a horizontal coil and a vertical coil.

* * * * *